US010689944B2

(12) United States Patent
Schuldes et al.

(10) Patent No.: US 10,689,944 B2
(45) **Date of Patent: *Jun. 23, 2020**

(54) SINGLE TRIP, OPEN-HOLE WELLBORE ISOLATION ASSEMBLY

(71) Applicant: Halliburton Energy Services, Inc., Houston, TX (US)

(72) Inventors: Roberto Francisco Schuldes, Houston, TX (US); Kevin Wendell Ardoin, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/513,852

(22) Filed: Jul. 17, 2019

(65) Prior Publication Data

US 2019/0338618 A1 Nov. 7, 2019

Related U.S. Application Data

(63) Continuation of application No. 15/748,930, filed as application No. PCT/US2015/053744 on Oct. 2, 2015, now Pat. No. 10,385,653.

(51) Int. Cl.
*E21B 33/13* (2006.01)
*E21B 43/10* (2006.01)
(Continued)

(52) U.S. Cl.
CPC ..... *E21B 33/13* (2013.01); *E21B 33/12* (2013.01); *E21B 34/06* (2013.01); *E21B 43/10* (2013.01); *E21B 2034/002* (2013.01)

(58) Field of Classification Search
None
See application file for complete search history.

(56) References Cited

U.S. PATENT DOCUMENTS 5,950,733 A 9/1999 Patel
8,327,933 B2 * 12/2012 Lynde ..... E21B 47/0005 166/177.4

(Continued)

FOREIGN PATENT DOCUMENTS

WO WO-2014-137314 9/2014
WO WO2014137314 * 9/2014 ..... E21B 33/12

OTHER PUBLICATIONS

International Search Report and Written Opinion, PCT/US2015/053744, ISA/KR, dated Jun. 21, 2016, 10 pages.

*Primary Examiner* — Anuradha Ahuja
(74) *Attorney, Agent, or Firm* — Haynes and Boone, LLP

(57) ABSTRACT

A method of isolating an open-hole section of a wellbore includes positioning, a liner, a valve, and a liner hanger that are attached to a working string adjacent an interface between the open-hole section and a cased section of the wellbore. The method includes injecting cement through the liner and the valve to form a first balanced cement plug within the open-hole section of the wellbore. Generally, the liner, the valve, and the liner hanger are secured within the balanced cement plug. After the balanced cement plug is set, the liner hanger is actuated and the liner, the valve, and the liner hanger are detached from the working string, which causes the valve to close and creates a mechanical barrier between the balanced cement plug and the working string. Additionally, the mechanical barrier is covered in cement to form another balanced cement plug.

21 Claims, 4 Drawing Sheets

(51) Int. Cl.

| | |
|---|---|
| ***E21B 33/12*** | (2006.01) |
| ***E21B 34/06*** | (2006.01) |
| ***E21B 34/00*** | (2006.01) |

(56) References Cited

U.S. PATENT DOCUMENTS

| | | | | |
|---|---|---|---|---|
| 2008/0251253 | A1* | 10/2008 | Lumbye | E21B 33/16 166/285 |
| 2012/0080190 | A1* | 4/2012 | Rytlewski | E21B 43/26 166/281 |
| 2012/0175113 | A1 | 7/2012 | Bullock et al. | |
| 2013/0000899 | A1* | 1/2013 | Broussard | E21B 33/124 166/278 |
| 2013/0118752 | A1 | 5/2013 | Hannegan et al. | |
| 2014/0124220 | A1* | 5/2014 | Stautzenberger | E21B 23/006 166/381 |
| 2014/0216746 | A1 | 8/2014 | Ballew et al. | |

* cited by examiner

SINGLE TRIP, OPEN-HOLE WELLBORE ISOLATION ASSEMBLY

CROSS-REFERENCE TO RELATED APPLICATION

This application is a continuation of U.S. patent application Ser. No. 15/748,930, filed Jan. 30, 2018, which is a National Stage Entry claiming the benefit of the filing date of, and priority to, International Patent Application No. PCT/US2015/053744, filed Oct. 2, 2015, the entire disclosures of which are hereby incorporated herein by reference.

TECHNICAL FIELD

The present disclosure relates generally to an isolation assembly used in an open-hole section of a wellbore, and specifically, to a single-trip, open-hole isolation assembly.

BACKGROUND

Often, an open-hole well may be temporarily or permanently abandoned for a variety of reasons. Generally, when a portion of an open-hole well is abandoned, a first hydraulic seal, such as concrete, is provided between the portion of the open-hole well to be abandoned and the wellhead, or the surface of the well. Then, a mechanical seal, such as a valve and a bridge plug, is provided between the first hydraulic seal and the surface of the well. Finally, a second hydraulic seal is then provided between the surface of the well and the mechanical seal. The process of providing the first and second hydraulic seals and the mechanical seal includes multiple trips downhole. That is, a first trip is generally required to set the first hydraulic seal and a second trip is required to set the mechanical seal and the second hydraulic seal. Considering the wellbore may be miles long, this may take days to complete, which requires the use of rig equipment and increases the operation cost of the well.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
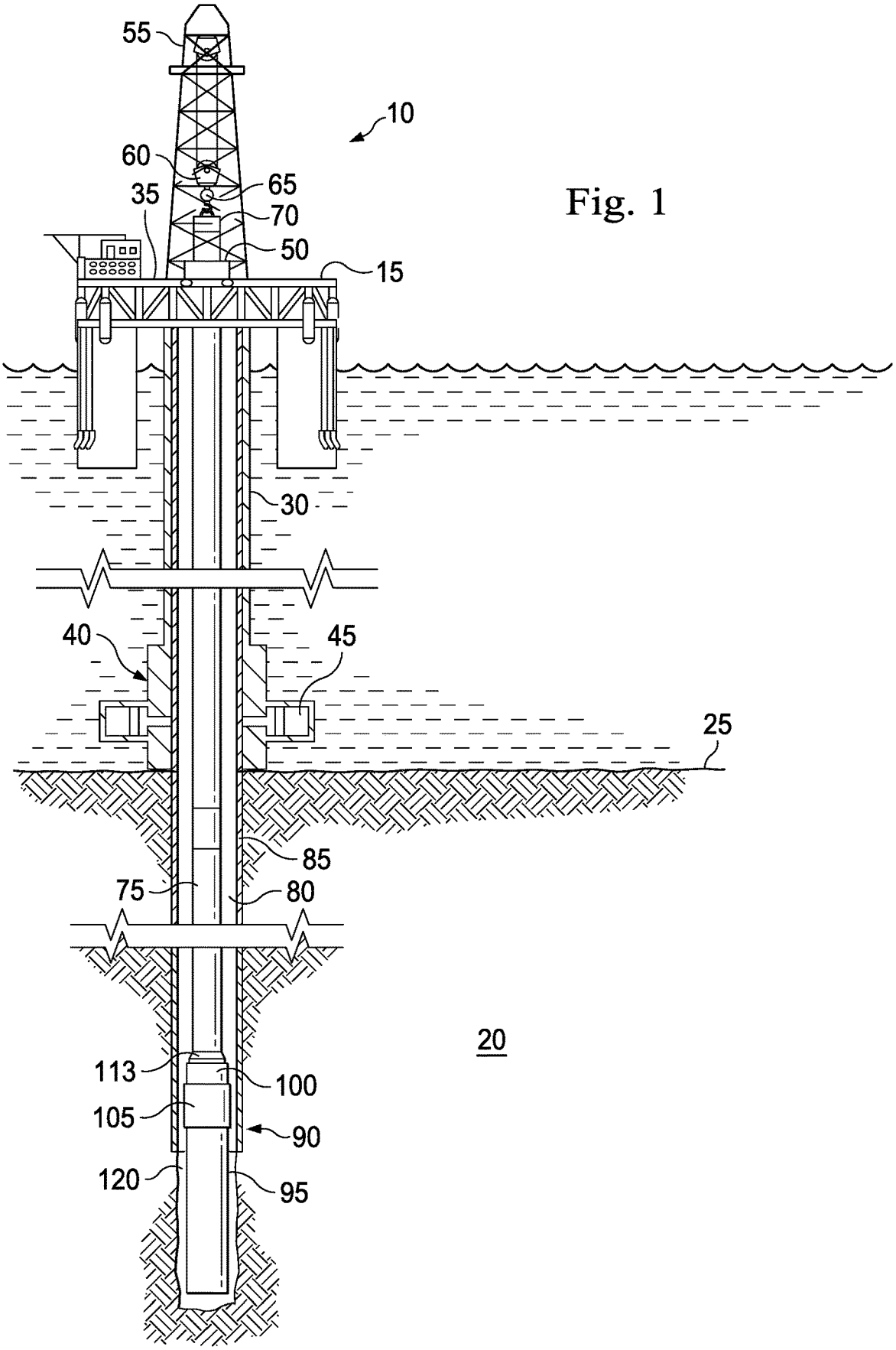
FIG. 1 is a schematic illustration of an offshore oil and gas platform operably coupled to single-trip wellbore isolation assembly, according to an exemplary embodiment of the present disclosure.

Illustrative embodiments and related methods of the present disclosure are described below as they might be employed in a single-trip, open-hole isolation assembly and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform generally designated 10, operably coupled by way of example to a single-trip, open-hole isolation assembly according to the present disclosure. Such an assembly could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel 70 for raising and lowering pipe strings, such as a substantially tubular, axially extending working string 75.

As in the present example embodiment of FIG. 1, a wellbore 80 extends through the various earth strata including the formation 20, with a portion of the wellbore 80 having a casing string 85 cemented therein. Disposed in the wellbore 80 is a single-trip, open-hole isolation assembly 90. Generally, the assembly 90 includes an elongated based pipe, or liner 95, and a mechanical isolation device, which may include a valve 100 and a liner stabilizer 105. The assembly 90 may be coupled to the working string 75 via a running tool 113, which includes a shifting tool 115 (shown in FIG. 2).

Figure 2:
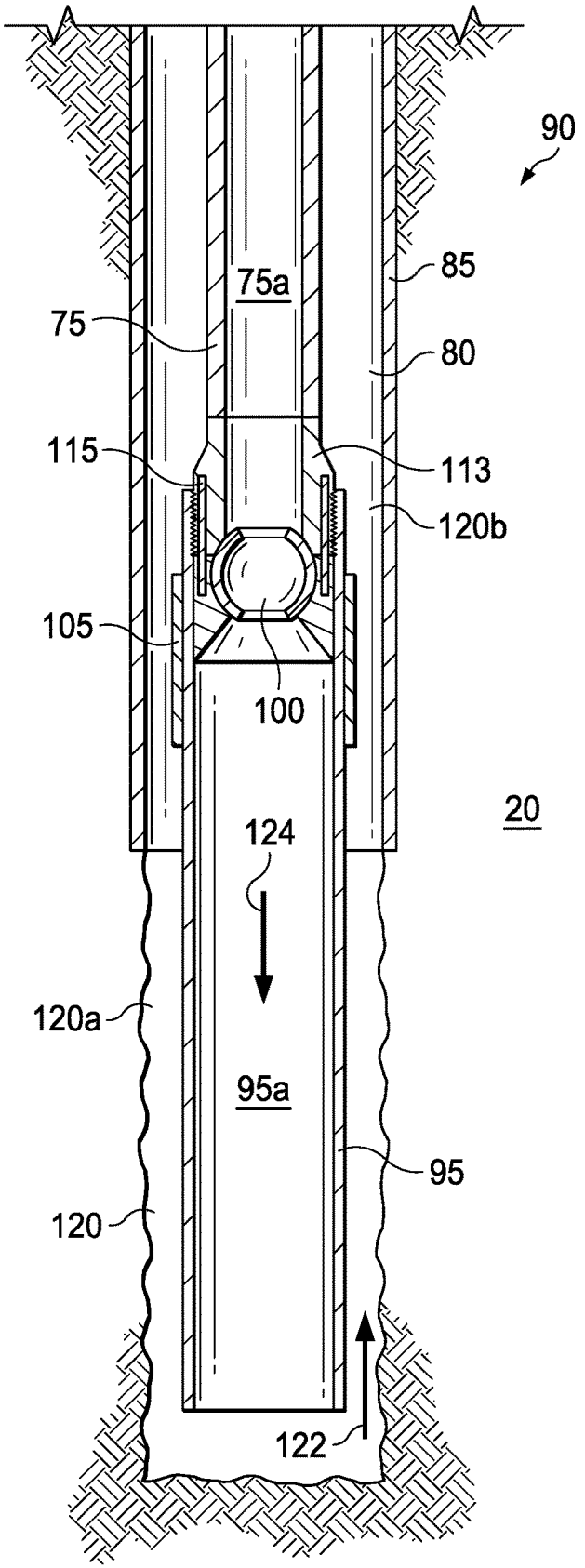
FIG. 2 illustrates a sectional view of the single-trip, open-hole wellbore isolation assembly of FIG. 1, according to an exemplary embodiment of the present disclosure.

FIG. 2 illustrates a sectional view of the assembly 90 of FIG. 1. Referring to FIG. 2, the liner 95 is adapted to extend adjacent an open-hole and cased-hole interface (a location within the wellbore 80 where the casing string 85 ends and the open-hole section of the wellbore 80 begins). The liner stabilizer 105 is generally positioned above the valve 100, but may alternatively be positioned adjacent or below the valve 100, as shown in FIG. 2.

The liner 95 may be a liner of any size and has an inner surface that forms a fluid flow passage 95*a* for moving fluids in a direction from the surface of the well into an annulus 120 that is formed between the assembly 90 and the wellbore 80.

The valve 100 may form a portion of the fluid flow passage 95*a* and is adapted to allow the flow of fluids from the surface of the well, through the fluid flow passage 95*a*, and into the annulus 120 when in an open position and is adapted to prevent the flow of fluids through the valve 100 and through the fluid flow passage 95*a* when in a closed position. The valve 100 may be a ball valve or any other type of valve that is capable of preventing flow of a fluid through the valve in both an uphole direction indicated by numeral 122 in FIG. 2 ("uphole direction 122") and a downhole direction indicated by numeral 124 in FIG. 2 ("downhole direction 124"). That is, the valve 100 is a bi-directional barrier valve that prevents bi-directional flow.

The liner stabilizer 105 may be hydraulic, mechanical, and/or expandable. In one or more exemplary embodiments, the liner stabilizer 105 includes any one or more of an expandable liner hanger, a modified liner hanger, heavy weight packer, etc. so that the liner stabilizer provides a bi-directional annulus seal between a first section 120*a* of the annulus 120 and a second section 120*b* of the annulus 120 and generally suspends the liner 95 in the wellbore 80. Thus, the liner stabilizer 105 is a bi-directional annulus seal hanger. In some embodiments, the liner stabilizer 105 includes both a liner hanger assembly and a packer assembly. However, in other embodiments, the liner stabilizer 105 omits the packer assembly and includes a liner hanger assembly that also provides a bi-directional annulus seal between the first section 120*a* of the annulus 120 and the second section 120*b* of the annulus 120. Additionally, in other embodiments, the liner stabilizer 105 omits the liner hanger assembly and includes a packer assembly that also suspends the liner 95 in the wellbore 80. The liner stabilizer 105 is generally positioned within the casing 85 and above the open-hole and cased-hole interface.

The working string 75 extends from the surface of the well and forms a flow passage 75*a*. The working string 75 may include the running tool 113 and the shifting tool 115 that is sized to shift the valve 100 from an open position to a closed position and/or from a closed position to an open position. The working string 75 is removable from the assembly 90. When attached to the assembly 90, the flow passage 75*a* is in fluid communication with the flow passage 95*a*. When detached from the assembly 90, the flow passage 75*a* is in fluid communication with the wellbore 80.

Figure 3:
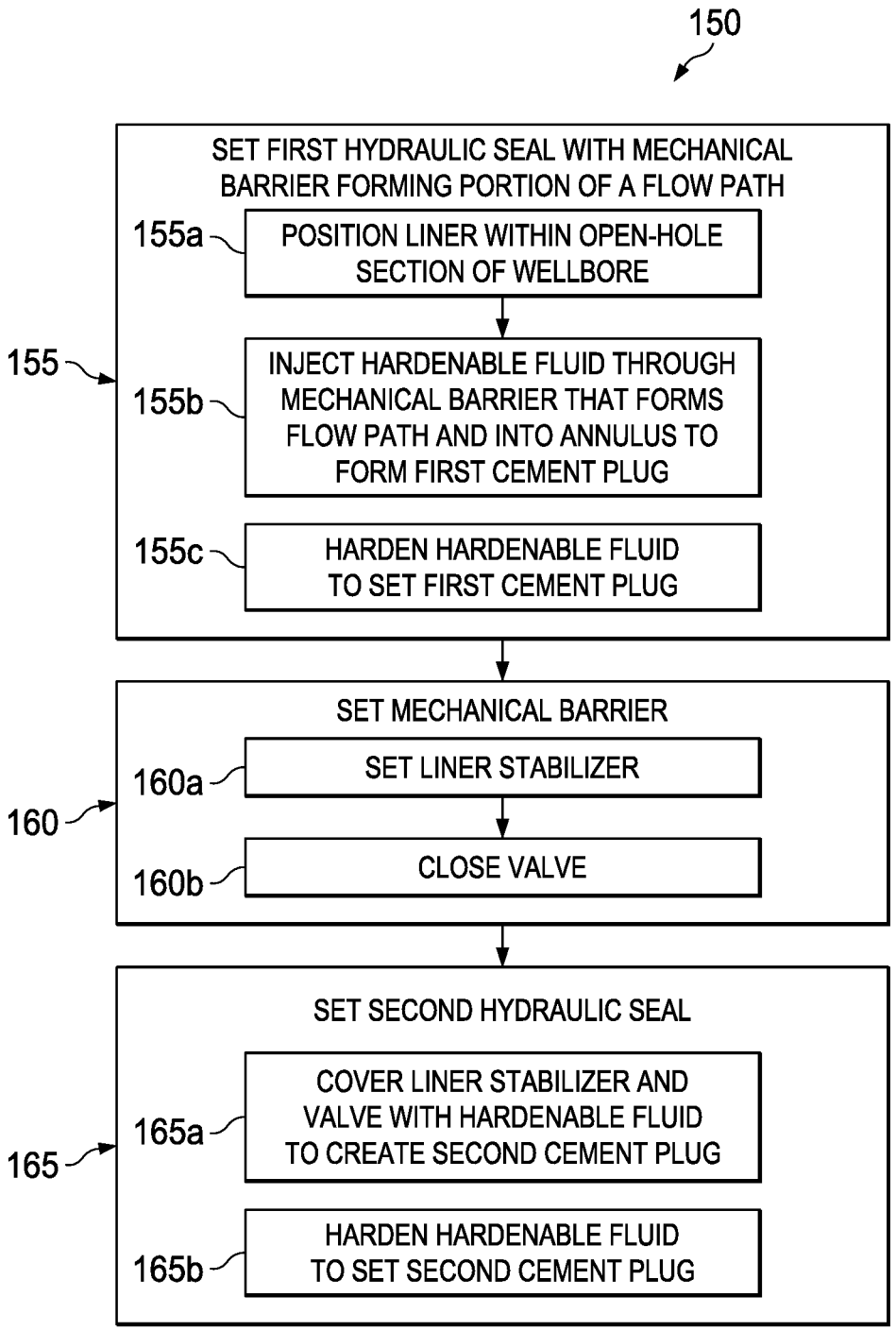
FIG. 3 is a flow chart illustration of a method of operating the assembly of FIG. 2, according to an exemplary embodiment.

FIG. 3 is a flow chart illustration of a method 150 of operating the assembly of FIG. 2 and includes setting a first hydraulic seal with the mechanical barrier forming a portion of the flow path 95*a* at step 155; setting the mechanical barrier at step 160; and setting a second hydraulic seal at step 165.

Figure 4:
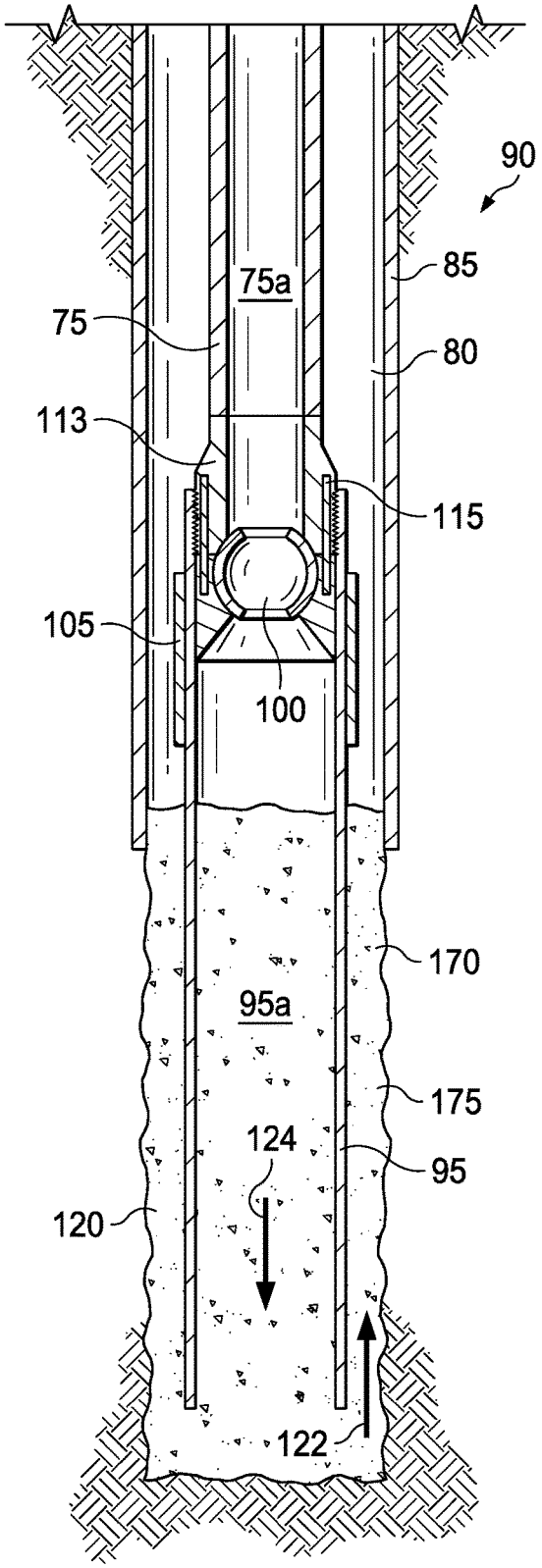
FIG. 4 illustrates a sectional view of the assembly of FIG. 2 during a step of the method of FIG. 3, according to an exemplary embodiment of the present disclosure.

Referring to FIG. 4, the step 155 includes setting the first hydraulic seal with the mechanical barrier forming a portion of the flow path 95*a*. The step 155 may include substeps of positioning at least a portion of the liner 95 within the open-hole section of the wellbore 80 at substep 155*a*; injecting a hardenable fluid 170 such has cement through the mechanical barrier (i.e., the valve 100 and liner stabilizer 105) that forms the flowpath 95*a* at substep 155*b*; and hardening the hardenable fluid to set a first cement plug 175 at substep 155*c*. Generally, during the substep 155*a*, the valve 100 is in the open position such that the passage 75*a* is in fluid communication with the passage 95*a*. At least a portion of the liner 95 extends within an open-hole section of the wellbore 80 and another portion extends within the cased-hole section of the wellbore at the step 155. During the substep 155*b*, cement or other hardenable fluid flows through the passage 75*a*, through the valve 100, and through the passage 95*a* in the direction 124. After exiting the liner 95, the cement flows into the annulus 120 and uphole in the direction 122 such that the cement engages the casing 85. A portion of the cement remains in the flow path 95*a*. Together, the cement in the flow path 95*a* and the cement in the annulus 120 form the first cement plug 175. As the hardenable fluid hardens, the first cement plug 175 is set in place and the liner 95 is secured in the first cement plug 175 at the substep 155*c*. The first cement plug 175 hardens, or sets, to form a hydraulic seal to plug the open-hole section of the wellbore 80 and fluidically isolate the open-hole section of the wellbore 80 from the wellhead, or the surface of the well. The hydraulic seal prevents fluids from exiting the formation 20 and entering the annulus 120.

Figure 5:
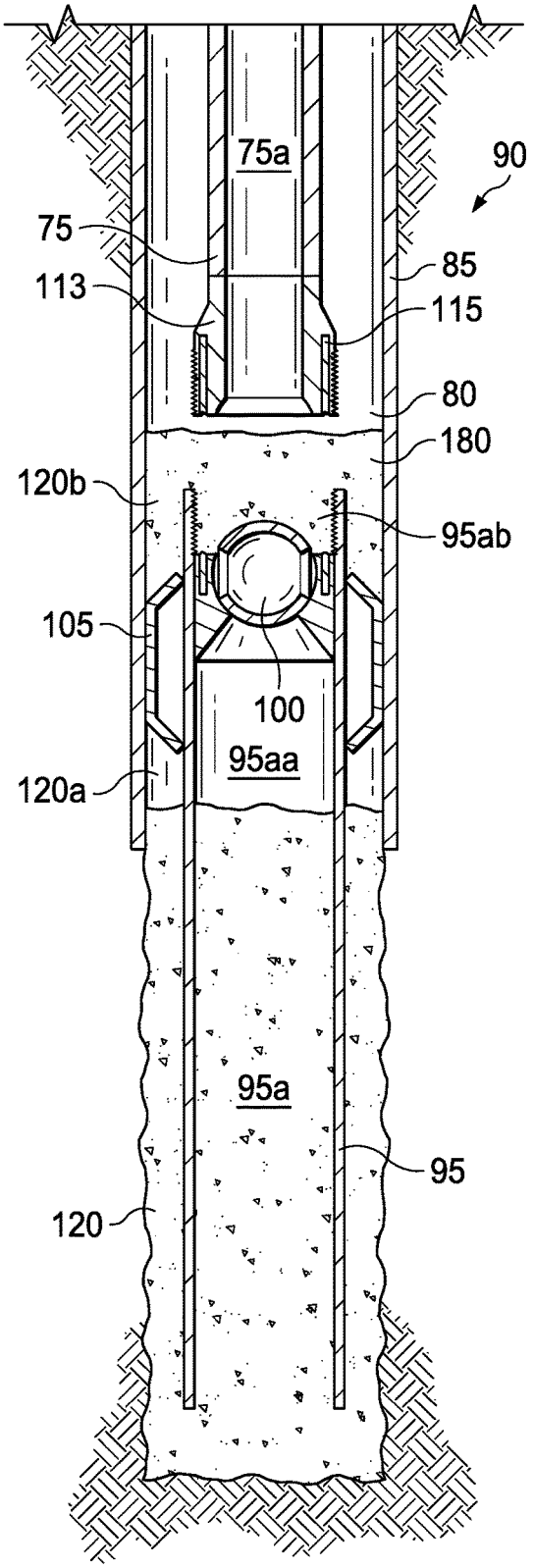
FIG. 5 illustrates a sectional view of the assembly of FIG. 2 during another step of the method of FIG. 3, according to an exemplary embodiment of the present disclosure.

Referring to FIG. 5, and at the step 160, the mechanical barrier is set. The step 160 may include the substeps of setting the liner stabilizer 105 at substep 160*a* and closing the valve 100 at substep 160*b*. At the substep 160*a*, the liner stabilizer 105 is set. In one exemplary embodiment, the liner stabilizer 105 may be set by dropping a setting ball from the surface of the well down through the fluid passage 75*a*. The setting ball may then engage the liner stabilizer 105 to set the liner stabilizer 105. As the liner stabilizer 105 is a bi-directional annulus seal hanger, setting the liner stabilizer 105 fluidically isolates the first portion 120*a* of the annulus 120 from the second portion 120*b* of the annulus. The liner stabilizer 105 defines the boundaries of first portion 120*a* and the second portion 120*b*. Additionally, setting the liner stabilizer 105 secures the liner 95 relative to the casing 85. At the substep 160*b*, the working string 75 and/or the running tool 113 is detached or removed from the assembly 90. When the running tool 113 is detached from the assembly 90, or directly before or after the running tool 113 is detached from the liner 95, the shifting tool 115 shifts the position of the valve 100 from the open position to the closed position. In one embodiment, the detachment of the working string 75 and/or the running tool 113 triggers the closure of the valve 100. Closing the valve 100 fluidically isolates a first portion of 95*aa* of the flow passage 95*a* from a second portion 95*ab* of the flow passage 95*a*, with the boundaries of the first portion 95*aa* and the second portion 95*ab* defined by the valve 100. With the valve 100 closed and the liner stabilizer 105 set, the open-hole section of the wellbore (and the first cement plug 175) is fluidically isolated from the surface of the well and from the working string 75. That is, the first portion 120*a* of the annulus 120 is fluidically isolated from the second portion 120*b* of the annulus 120 and the first portion 95*aa* of the flow passage 95*a* is fluidically isolated from the second portion 95*ab* of the flow passage 95*a*.

At the step 165, the second hydraulic seal is set. The step 165 may include the substeps of covering the liner stabilizer 105 and the valve 100 with hardenable fluid to create a second cement plug at substep 165*a* and hardening the hardenable fluid to set the second cement plug at substep 165*b*. At the substep 165*a*, hardenable fluid such as cement flows downhole through the flow passage 75*a* of the working string and into the wellbore 80. The hardenable fluid flows into the second portion 120*b* of the annulus 120 and the second portion 95*a* b of the flow path 95*a*. The hardenable fluid covers the liner stabilizer 105 and the valve 100 to form a second cement plug 180. At the substep 165*b*, the hardenable fluid is hardened to set the second cement plug 180. The second cement plug 180 hardens, or sets, to form a second hydraulic seal. The second hydraulic seal fluidically isolates the valve 100, the liner stabilizer 105, and the open-hole portion of the wellbore 80. That is, the second hydraulic seal fluidically isolates the first hydraulic seal and the mechanical barrier from the surface of the well.

In an exemplary embodiment, the method 150 is completed in one "trip" downhole. That is, the running tool 113 remains downhole during and between the steps 155 and 160 and between the steps 160 and 165. Thus, the method 150 results in a dual barrier above a hydrocarbon zone, which is often required in an open-hole plug and abandonment operation. Thus, the method 150 and the apparatus 90 results in a one-trip dual barrier. Considering the wellbore may be miles long, completing a trip downhole may take days to complete. Thus, using the method 150 and/or the use of the assembly 90 reduces the amount of time needed to install a dual barrier in an abandoned well, resulting in reduced operation costs.

In an exemplary embodiment, the method 150 may also include the steps of pressure testing each of the first hydraulic seal, the mechanical barrier, and the second hydraulic seal for integrity of the barrier. Additionally, the method 150 may also include a step of retrieving the working string 75 and the running tool 113 from the wellbore after the substep 165*a*.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a method of isolating an open-hole section of a wellbore has been described. Embodiments of the method may generally include extending a liner that is attached to a working string into the open-hole section of the wellbore, the liner having an interior flow passage; injecting a first hardenable fluid into the working string so that the first hardenable fluid: flows through a valve that separates a first portion of the interior flow passage from a second portion of the interior flow passage; and fills a first annulus formed between the liner and the open-hole section of the wellbore to plug the open-hole section of the wellbore; and closing the valve to fluidically isolate the first portion of the interior flow passage from the second portion of the interior flow passage. For any of the foregoing embodiments, the method may include any one of the following elements, alone or in combination with each other:

- Setting a liner stabilizer attached to the liner to fluidically isolate a first portion of a second annulus formed between the liner and a cased section of the well from a second portion of the second annulus.
- Detaching the liner from the working string.
- Injecting a second hardenable fluid into the working string so that the second hardenable fluid flows into the wellbore to cover the liner, the valve, and the liner stabilizer with the second hardenable fluid.
- Injecting the first hardenable fluid into the working string to fill the first annulus formed between the liner and the open-hole section of the wellbore forms a first cement plug that is a first hydraulic seal.
- Closing the valve and setting the liner stabilizer creates a mechanical barrier between the first cement plug and the working string.
- Injecting a second hardenable fluid into the working string so that the second hardenable fluid flows into the wellbore to cover the liner, the valve, and the liner stabilizer with the second hardenable fluid creates a second cement plug that is a second hydraulic seal.

At least one of the first hardenable material and the second hardenable material is cement.

- Detaching the liner from the working string closes the valve.
- Surrounding at least a portion of the liner with the first hardenable material such that the liner is secured in the first cement plug.
- The liner hanger is a bi-directional annulus seal liner hanger.
- The valve is a bi-directional valve.

Thus, a method of isolating an open-hole section of a wellbore has been described. Embodiments of the apparatus may generally include extending a liner within a wellbore and adjacent an interface between the open-hole section of the wellbore and a cased section of the wellbore; injecting a first hardenable fluid through a fluid passage formed in the liner and into an annulus formed between the liner and the open-hole section of the wellbore to form a first cement plug; mechanically isolating the first cement plug from a surface of the well, including: closing a bi-directional valve that is coupled to the liner and that forms a portion of the fluid passage; and setting a bi-directional annulus seal liner stabilizer that is coupled to the liner; and covering the bi-directional annulus seal liner stabilizer and the bi-directional valve with a second hardenable fluid to form a second cement plug. For any of the foregoing embodiments, the apparatus may include any one of the following elements, alone or in combination with each other:

- At least one of the first hardenable material and the second hardenable material is cement.

Setting the liner stabilizer that is coupled to the liner results in the liner being secured to the cased section of the wellbore.

Securing the liner within the first cement plug.

Detaching the liner from a working string that extends to the surface of the well.

Thus, a single-trip isolation assembly for use in a wellbore has been described. Embodiments of the apparatus may generally include a liner that forms an interior fluid flow passage; a liner stabilizer attached to the liner; and a valve forming a portion of the interior fluid flow passage and positioned between a first portion of the interior fluid flow passage and a second portion of the interior fluid flow passage; wherein the wellbore is plugged in a single trip using the single-trip isolation assembly. For any of the foregoing embodiments, the apparatus may include any one of the following elements, alone or in combination with each other:

A shifting tool engaging the valve, the shifting tool having a first position associated with the valve being in an open position and a second position associated with the valve being in a closed position.

The liner stabilizer is a bi-directional annulus seal liner stabilizer and the valve is a bi-directional valve.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A method of isolating an open-hole section of a wellbore, the method comprising:

extending a liner that is attached to a working string into the open-hole section of the wellbore, the liner having an interior flow passage;

injecting a first hardenable fluid into the working string and thereby causing the first hardenable fluid to:

flow through a first portion of the interior flow passage, then through a valve that separates the first portion of the interior flow passage from a second portion of the interior flow passage, then through the second portion of the interior flow passage, and then into a first annulus at a location downhole from the valve, the first annulus being formed between the liner and the open-hole section of the wellbore; and form a first plug with the first hardenable fluid in the open-hole section of the wellbore to plug both the first annulus and the second portion of the interior flow passage; and fluidically isolating the first plug from the working string, comprising:

closing the valve to fluidically isolate the first portion of the interior flow passage from the second portion of the interior flow passage.

2. The method of claim 1, wherein fluidically isolating the first plug from the working string further comprises:

setting a liner stabilizer attached to the liner to fluidically isolate a first portion of a second annulus formed between the liner and a cased section of the wellbore from a second portion of the second annulus.

3. The method of claim 2, further comprising detaching the liner from the working string.

4. The method of claim 3, further comprising injecting a second hardenable fluid into the working string so that the second hardenable fluid:

flows into the cased section of the wellbore at a location uphole from the valve to cover the liner, the valve, and the liner stabilizer with the second hardenable fluid; and forms a second plug in the cased section of the wellbore to plug both the second annulus and the first portion of the interior flow passage.

5. The method of claim 4, wherein the second plug is a hydraulic seal.

6. The method of claim 4, wherein at least one of the first hardenable fluid and the second hardenable fluid is cement.

7. The method of claim 3, wherein detaching the liner from the working string closes the valve.

8. The method of claim 2, wherein the liner stabilizer is a bi-directional annulus seal liner hanger.

9. The method of claim 1, wherein the first plug is a hydraulic seal.

10. The method of claim 1, wherein injecting the first hardenable fluid into the working string further causes the first hardenable fluid to surround at least a portion of the liner such that the liner is secured in the first plug.

11. The method of claim 1, wherein the valve is a bi-directional valve.

12. A single-trip isolation assembly for use in isolating an open-hole section of a wellbore, the single-trip isolation assembly comprising:

a working string;

a liner attachable to, and detachable from, the working string, the liner having an interior flow passage and being extendable into an open-hole section of the wellbore;

a valve separating a first portion of the interior flow passage from a second portion of the interior flow passage, the valve being actuable from an open position, in which the first and second portions of the interior fluid flow passage are in fluid communication with each other via the valve, to a closed position, in which the valve fluidically isolates the first and second portions of the interior fluid flow passage from each other;

wherein, while the liner is attached to the working string and extended into the open-hole section of the wellbore and the valve is in the open position:

the working string is adapted to flow a first hardenable fluid into the first portion of the interior flow passage, then through the valve, then through the second portion of the interior flow passage, and then into a first annulus formed between the liner and the open-hole section of the wellbore at a location downhole from the valve so that the first hardenable fluid forms a first plug in the open-hole section of the wellbore to plug both the first annulus and the second portion of the interior flow passage;

and wherein, after the first plug is formed in the open-hole section of the wellbore, the valve is closable to at least partially fluidically isolate the first plug from the working string.

13. The single-trip isolation assembly of claim 12, wherein the first plug is a hydraulic seal.

14. The single-trip isolation assembly of claim 13, wherein the valve is a bi-directional valve.

15. The single trip isolation assembly of claim 12, further comprising:

a liner stabilizer attached to the liner and settable, after the first plug is formed in the open-hole section of the wellbore:

to fluidically isolate a first portion of a second annulus formed between the liner and a cased section of the wellbore from a second portion of the second annulus; and to at least partially fluidically isolate the first plug from the working string.

16. The single-trip isolation assembly of claim 15, wherein the liner stabilizer is a bi-directional annulus seal liner hanger.

17. The single-trip isolation assembly of claim 15, wherein, after the first plug is formed in the open-hole section of the wellbore, the valve is closed, the liner stabilizer is set, and the liner is detached from the working string: the working string is further adapted to flow a second hardenable fluid into the cased section of the wellbore at a location uphole from the valve to cover the liner, the valve, and the liner stabilizer with the second hardenable fluid so that the second hardenable fluid forms a second plug in the cased section of the wellbore to plug both the second annulus and the first portion of the interior flow passage.

18. The single-trip isolation assembly of claim 15, wherein the second plug is a hydraulic seal.

19. The single-trip isolation assembly of claim 15, wherein at least one of the first hardenable fluid and the second hardenable fluid is cement.

20. The single-trip isolation assembly of claim 15, wherein the liner is detachable from the working string to close the valve.

21. The single-trip isolation assembly of claim 12, wherein the flow of the first hardenable fluid further causes the first hardenable fluid to surround at least a portion of the liner such that the liner is secured in the first plug.

* * * * *